US006736287B2

(12) United States Patent
Sauer et al.

(10) Patent No.: US 6,736,287 B2
(45) Date of Patent: May 18, 2004

(54) OPTIONALLY HANGABLE CONTAINER AND DISPENSING METHOD

(75) Inventors: Barbara O. Sauer, Fremont, WI (US); Richard Frederick House, Geneva, IL (US); Paul Roy Schmidt, Neenah, MI (US); Herb F. Velazquez, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/436,771

(22) Filed: May 13, 2003

(65) Prior Publication Data

US 2003/0192903 A1 Oct. 16, 2003

Related U.S. Application Data

(62) Division of application No. 09/727,811, filed on Nov. 30, 2000, now Pat. No. 6,588,626.

(51) Int. Cl.[7] ..... B65G 59/00
(52) U.S. Cl. ..... 221/283; 206/554
(58) Field of Search ..... 221/45, 46, 53, 221/49, 63, 282, 283, 48; 206/812, 494, 554, 205

(56) References Cited

U.S. PATENT DOCUMENTS

| | | | |
|---|---|---|---|
| 2,122,048 | A | 6/1938 | Shapiro |
| 2,279,658 | A | 4/1942 | Crebbs |
| 3,089,586 | A | 5/1963 | Cole |
| 3,095,087 | A | 6/1963 | Yates |
| 3,233,777 | A | 2/1966 | Farha |
| 3,738,721 | A | 6/1973 | Maschek et al. |
| 3,744,448 | A | 7/1973 | Boone |
| 3,794,253 | A | 2/1974 | Megdall |
| 3,824,953 | A | 7/1974 | Boone |
| 3,830,198 | A | 8/1974 | Boone |
| 3,834,636 | A | 9/1974 | Linick |
| 3,837,595 | A | 9/1974 | Boone |
| 4,004,687 | A | 1/1977 | Boone |
| 4,017,002 | A | 4/1977 | Doyle et al. |
| D247,077 | S | 1/1978 | Gruber |
| 4,101,026 | A | 7/1978 | Bonk |
| 4,106,617 | A | 8/1978 | Boone |
| 4,205,802 | A | 6/1980 | Economakis |
| 4,235,333 | A | 11/1980 | Boone |
| 4,274,573 | A | 6/1981 | Finkelstein |
| D262,422 | S | 12/1981 | Ortiz et al. |
| 4,385,733 | A | 5/1983 | O'Keefe |
| 4,453,649 | A | 6/1984 | Origuchi |
| 4,513,923 | A | 4/1985 | Ulics |

(List continued on next page.)

FOREIGN PATENT DOCUMENTS

| | | |
|---|---|---|
| FR | 950841 | 10/1949 |
| FR | 1315415 | 12/1963 |
| WO | WO 86/05076 A1 | 9/1986 |
| WO | WO 96/33647 A1 | 10/1996 |

OTHER PUBLICATIONS

Patent Cooperation Treaty Search Report from the International Search Authority, International Application No. PCT/US 01/45197 dated Apr. 11, 2002.

*Primary Examiner*—Kenneth W. Noland
(74) *Attorney, Agent, or Firm*—Scott A. Baum

(57) ABSTRACT

A product comprising an absorbent paper material and a dispenser adapted to hanging from a support such as a towel bar or a hook is disclosed. The dispenser can be optionally located on a surface instead of hung from a support, and a space at the bottom of the dispenser protects the absorbent paper material from damage due to liquid spills on the surface. The dispenser has an advantage of two distinct dispensing modes, and protection of the unused absorbent paper material from liquid spills.

7 Claims, 4 Drawing Sheets

U.S. PATENT DOCUMENTS

| | | | |
|---|---|---|---|
| 4,607,809 | A | 8/1986 | Sineni et al. |
| D289,140 | S | 4/1987 | Fischer et al. |
| 4,662,577 | A | 5/1987 | Lewis |
| 4,690,345 | A | 9/1987 | Cotey |
| D293,182 | S | 12/1987 | Carter |
| 4,739,809 | A | 4/1988 | Adams |
| 4,765,475 | A | 8/1988 | Kaysserian |
| 4,834,316 | A | 5/1989 | DeLorean |
| 4,913,312 | A | 4/1990 | Boutin |
| 4,978,095 | A | 12/1990 | Phillips |
| 5,054,675 | A | 10/1991 | Taves |
| 5,076,424 | A | 12/1991 | Nakamura |
| 5,076,465 | A | 12/1991 | Lawson |
| 5,228,632 | A | 7/1993 | Addison et al. |
| 5,375,928 | A | 12/1994 | Yarng et al. |
| 5,398,824 | A | 3/1995 | Wolff et al. |
| 5,447,227 | A | 9/1995 | Kosberg |
| 5,565,258 | A | 10/1996 | McConnell et al. |
| 5,605,250 | A | 2/1997 | Meiron et al. |
| 5,623,880 | A | 4/1997 | Kuntz |
| 5,799,895 | A | 9/1998 | Michaud et al. |
| 5,857,586 | A | 1/1999 | Scherr |
| 5,897,074 | A | 4/1999 | Marino |
| 5,904,316 | A | 5/1999 | Dunning et al. |
| 5,951,762 | A | 9/1999 | Shangold et al. |
| 5,964,351 | A | 10/1999 | Zander |
| D419,016 | S | 1/2000 | Twitty |
| 6,112,936 | A | 9/2000 | Arizmendi |
| 6,439,386 | B1 | 8/2002 | Sauer et al. |
| 6,588,626 | B2 | 7/2003 | Sauer et al. |

OPTIONALLY HANGABLE CONTAINER AND DISPENSING METHOD

This application is a divisional of application Ser. No. 09/727,811 entitled OPTIONALLY HANGABLE CONTAINER AND DISPENSING METHOD and filed in the U.S. Patent and Trademark Office on Nov. 30, 2000 now U.S. Pat. No. 6,588,626. The entirety of application Ser. No. 09/727,811 is hereby incorporated by reference.

BACKGROUND

The present invention relates to a product comprising an absorbent paper material in a container, and the dispensing method for the absorbent paper material. In households today there is an increasing demand for novel ways to dispense absorbent paper materials such as facial tissue, bathroom tissue, paper towels, napkins, and the like. In particular, with the increase in the number of items stored on counters and shelves and the resulting decrease in available counter space, there is a need to provide dispensing methods or products of absorbent paper materials, which reduce or eliminate the amount of counter space required. Thus, dispensers or products that have a reduced footprint while still dispensing standard size absorbent paper materials, or hanging-dispensers or products, which eliminate the need for any counter space, are consumer preferred.

In addition, absorbent paper materials are frequently used in areas with exposure to liquids and moisture such as kitchens and bathrooms. Conventional containers of absorbent paper materials, when placed on counter surfaces, can be damaged by associated liquid spills. By providing a container that hangs or a container that protects the absorbent paper material from moisture, the product's usefulness to consumers is enhanced.

For the foregoing reasons, there is a need for a packaged absorbent paper material in a container that reduces the need to place the container on a counter, or that protects the absorbent paper material inside the container from liquids.

SUMMARY OF THE INVENTION

The present invention is directed to a product comprising an absorbent paper material in a container that satisfies one or more of these needs. Hence in one aspect, the invention resides in a packaged product comprising: a container having a first end, a second end, and a sidewall containing an interfolded absorbent paper material; a first opening into the container adapted to dispense the interfolded paper material; and at least one other opening into the container adapted to hang the container from a support member.

In another aspect the invention resides in a packaged product comprising: a container containing an absorbent paper material, the container and the absorbent paper material having a combined center of gravity; the container having a first end, a second end, a sidewall, and a first opening adapted to dispensing the absorbent paper material; and the container having at least one other opening adapted to hanging the container from a support member whereby the center of gravity is located beneath the support member.

In yet another aspect, the invention resides in a packaged product comprising: a container having a first end, a second end, a sidewall, and a partition attached to an interior surface of the container forming a first compartment and a second compartment, a first opening into the interior of the first compartment adapted to dispensing an absorbent paper material located inside the first compartment, and a space provided by the second compartment adapted to elevating the absorbent paper material away from surfaces protecting the absorbent paper material from damage due to liquids on the surface.

In yet another aspect, the invention resides in a method of dispensing an absorbent paper material in a container comprising the acts of: removing at least one cover from the container having a first and a second opening, the cover covering at least a portion of the first or the second opening; hanging the container from a support member engaging the second opening such that a center of gravity of the container and absorbent paper material is lower than the support member; and withdrawing the absorbent paper material through the first opening.

In still another aspect, the invention resides in a method of dispensing an absorbent paper material in a container comprising the acts of: providing a container having a partition attached to an interior surface of the container forming a first compartment and a second compartment, the container having a first end, a second end, a sidewall, and a first opening into the interior of the first compartment which contains the absorbent paper material; placing the container on a surface with the second compartment beneath the first compartment such that a space provided by the second compartment elevates the absorbent paper material from the surface protecting the absorbent paper material from damage due any liquids on the surface; and withdrawing the absorbent paper material through the first opening.

The above aspects of the invention provide a significant advantage in that the absorbent paper material is protected from moisture damage by liquids on surfaces and counters by either hanging the container, or providing a space between the absorbent paper material and the surface. Another advantage is that the product takes up less counter space by either reducing the footprint of the container, or by hanging the container removing the need to place it on a counter. An additional advantage is that the container has two or more dispensing modes allowing consumers a choice of product location and dispensing method.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE DRAWINGS

Figure 1:
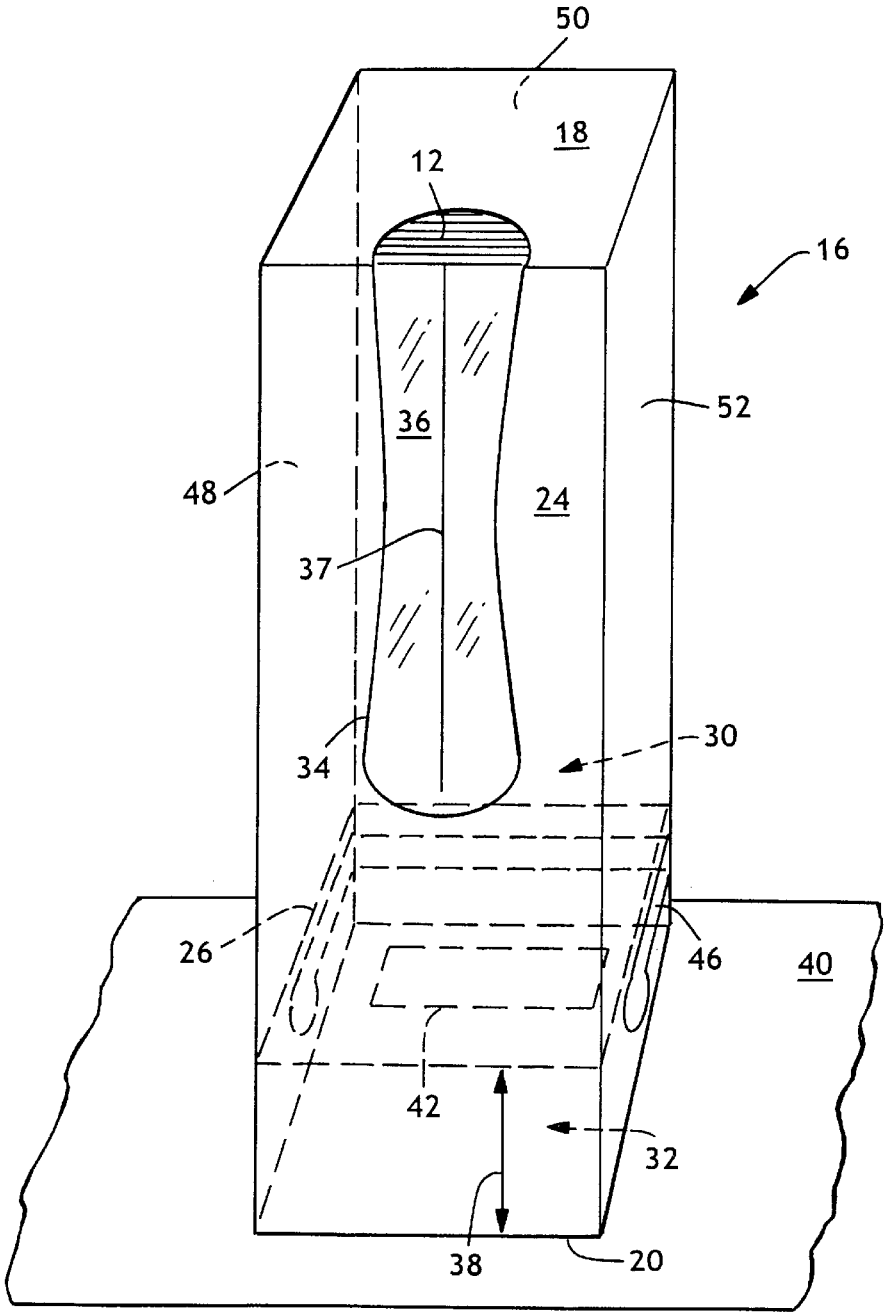
FIG. 1 is an isometric view of an embodiment of the invention.

Referring to FIG. 1, a product comprising a container 16 and an absorbent paper material 12 is shown. As used throughout the descriptions of the figures, the same reference numbers are used to represent the same features unless otherwise stated. The container 16, as herein described, is designed to provide an advantage of two separate dispensing modes. The container 16 may be any size or shape useful for containing an absorbent paper material 12. In a specific embodiment, the container 16 is disposable upon depletion of the absorbent paper material and constructed from board, carton stock, heavy paper, and the like. However, it is possible to design the container 16 to be refillable, and constructed from a sturdier substrate such as plastic or metal. A refillable container, or a dispenser, could be used with an absorbent paper material purchased in another pre-packaged container, such as a facial tissue carton, that is placed into the dispenser. It is also possible to refill the container with absorbent paper materials purchased in bulk and not housed in individual cartons.

In a specific embodiment, the container 16 has a first end 18, a second end 20, and a sidewall comprised of panels 24, 48, 50, and 52. The container 16 forms a generally rectangular box 11 inches in height by 4 inches in depth by 4 inches in width. Generally rectangular means that at least one side of the container 16 is rectangular, although not all sides of the container 16 necessarily meet at right angles. Thus, a three dimensional parallelogram is generally rectangular while a cylinder is not. However, it is possible to construct the container 16 in a spherical shape, or a cylindrical shape, or any other three-dimensional volume by use of a differently shaped sidewall and/or end panel.

In a specific embodiment, a partition 26 is attached to an interior surface of the container 16 forming a first compartment 30, and a second compartment 32. The first compartment 30 is 9 inches in height, and the second compartment 32 is 2 inches in height. An absorbent paper material 12 is located in the first compartment 30. However, it is possible to construct the container 16 with only a single compartment 30 eliminating the partition 26. The partition 26 has the advantage of better containing the absorbent paper material 12 as the container's orientation is changed, and the advantage of providing a second compartment 32 adapted to either hang the container 16 or elevate the absorbent paper material 12 from the surface 40.

A first opening 34 is provided into the interior of the first compartment 30. In a specific embodiment, the first opening 34 is located partially in the sidewall and partially in the first end 18. The first opening 34 is 8⅛ inches in total length with 7½ inches of this length in the sidewall, and the remaining ⅝ inch located in the first end. The first opening 34 tapers slightly from 1¾ inches at the ends to 1½ inches in the middle. The start of the first opening 34 is 1½ inches above the partition 26.

Construction of the first opening 34 partially in the sidewall, and partially in the first end 18 has the advantage of convenient dispensing independent of the container's orientation. Thus, acceptable dispensing performance is achieved for either of the container's orientations shown in FIG. 1 or FIG. 2. In FIG. 1, the absorbent paper material 12 is dispensed by pulling the absorbent paper material generally up and out of the first opening 34.

However, any size or style of opening configured to dispense an absorbent paper material 12 from the interior of the first compartment 30 is possible. The type of absorbent paper material 12 being dispensed will dictate the style of opening. The specific first opening 34 herein previously described has been found useful to dispense an interfolded stack of paper towels. Alternative first openings 34 may be located entirely in the first end 18, or may be located entirely in the sidewall.

All or a portion of the absorbent paper material 12 exposed by the first opening 34 may be covered by at least one first cover 36 as conventionally practiced with facial tissue cartons. For instance, a removable cover created by lines of perforation in the container 16 may occupy all or a portion of the first opening 34 (not shown). The removable cover is stripped from the container prior to dispensing the absorbent paper product 12. Alternatively, the absorbent paper material 12 may be covered by a poly film wrap that is removed (not shown). In a specific embodiment, a poly film window with a slit 37 is present as the first cover 36 covering the absorbent paper material 12. A removable cover, not shown, provides additional protection for the absorbent paper material during shipping, and may be used in combination with the poly film window. Similarly, the poly film wrap may be used in combination with the poly film window.

The second compartment 32 provides a space as indicated by the double arrow 38 between the absorbent paper material 12 and a surface 40. As previously mentioned, in a specific embodiment the height of this space is 2 inches. The space prevents any liquid, which is spilled on the surface 40, from reaching the absorbent paper material 12 and damaging the material prior to use.

In a specific embodiment, the container 16 is orientated vertically as shown with a greater height than width or depth. Such an orientation minimizes the footprint of the container 16, and the resulting space required on the surface 40. It is possible, however, to construct the container 16 with a greater depth or width than height while still providing a second compartment 32, and a space 38 between the absorbent paper material 12 and the surface 40. Such a dispenser may resemble a conventional facial tissue carton with a second compartment 32 located beneath the first compartment 30 containing the facial tissues. The shorter dispenser has the advantage of protecting the absorbent paper material 12 from liquid damage, but has a larger footprint and consumes more space on the surface 40.

Figure 2:
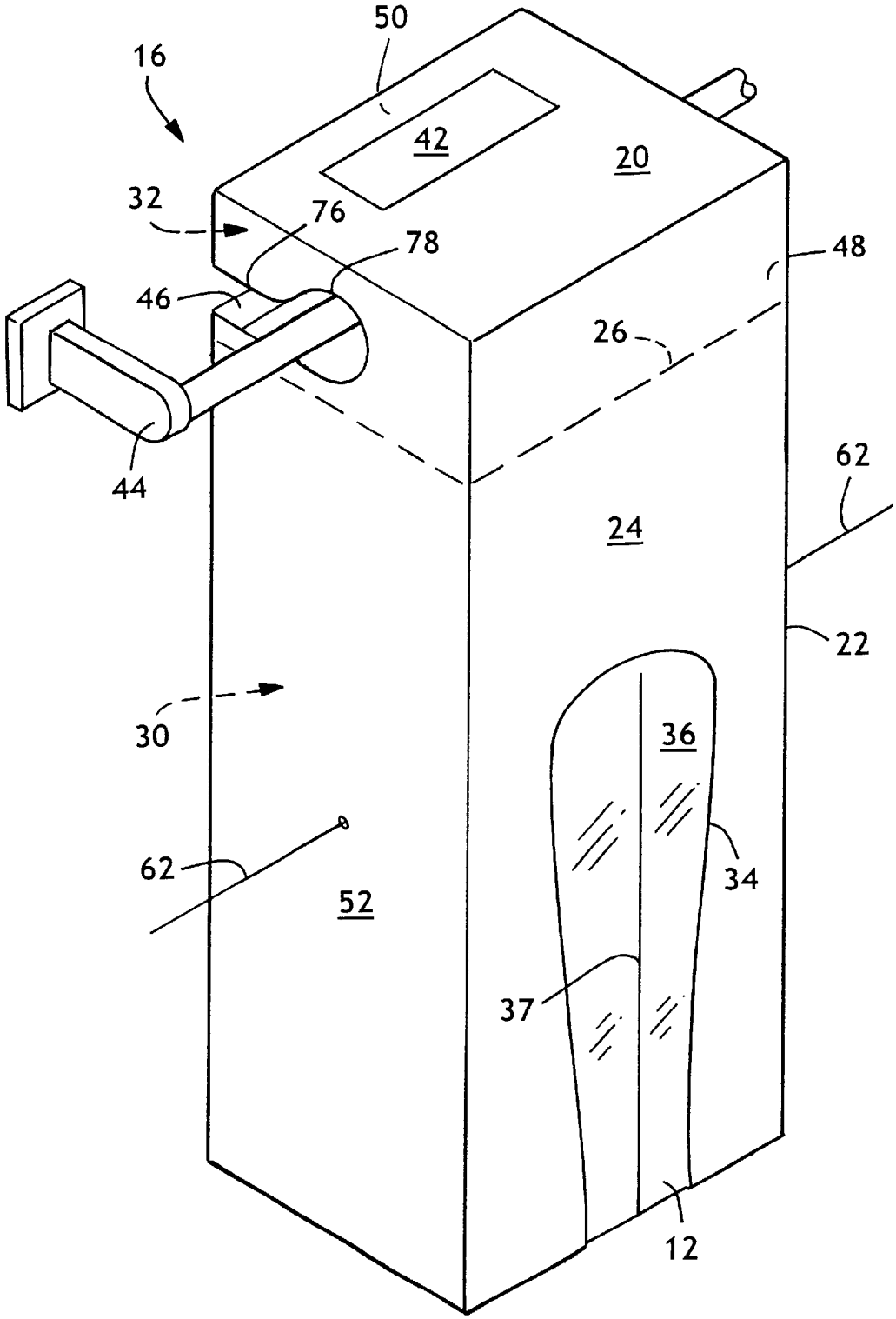
FIG. 2 is an isometric view of the embodiment of FIG. 1 hanging from a support member.

Optionally, as better seen in FIG. 2, an attachment member 42 is located on the second end 20 to attach the container 16 to the surface 40. In a specific embodiment, an adhesive is used on the second end 20 as the attachment member 42. Adhesive code number 9425 manufactured by 3M Corporation, PO Box 33053, St. Paul, Minn., 55133 has been found especially effective. The adhesive can be located on second end 20 close to the intersection of second end 20 and panel 50. This provides the best counter-balance force to prevent the container 16 from tipping over during the dispensing mode illustrated in FIG. 1. Alternative attachment members such as hook and loop material, magnets, or suction cups are possible.

FIG. 2 shows the same product of FIG. 1 being utilized in an alternative dispensing embodiment. In this orientation, the absorbent paper material 12 is dispensed by pulling the absorbent paper material generally down and out of the first opening 34. The container 16 is constructed with a second opening 46 into the interior of the second compartment 32 in order to hang the container from a support member 44. Alternatively, the second opening 46 can be located in the first compartment 30 if the container 16 is constructed without the partition 26. In a specific embodiment, the center of gravity axis 62 of the container 16 and the absorbent paper material 12 does not intersect with the second opening 46. Preferably, the second opening 46 is located near the second end 20 to maximize the distance between the second opening 46 and the center of gravity axis 62. This helps to minimize twisting of the container about support member 44 while dispensing the absorbent paper material 12.

In a specific embodiment, the container 16 is hung from a support member 44 that occupies a portion of the space provided by the second compartment 32. The second opening 46 may be an elongated keyhole opening to hang the container from a support member 44 comprising a bar, a single hole adapted to hang the container from a support member comprising a hook, or any other opening adapted to hanging the container. The second opening 46 may be located anywhere into the interior of the second compartment including panels 24, 48, 50, 52, and second end 20. The second opening also may be located anywhere into the interior of the first compartment 30. More than one second opening, in combination, adapted to hang the container 16 is possible. For instance, two opposing holes in panels 48 and 52 would allow container 16 to hang from the support member 44, or from a support member configured to hang a roll of paper towels. Alternatively, two support members 44 comprising hooks can engage two holes located anywhere in the container 16 to hang the container.

In a specific embodiment, the second opening 46 comprises a 1½ inch diameter circle connected to a 1¼ inch by 1 inch rectangle on panel 52, a 1 inch by 4 inch rectangle on adjacent panel 50, and a 1½ inch diameter circle connected to a 1¼ inch by 1 inch rectangle on the next adjacent panel 48; all the openings are interconnected forming an elongated keyhole opening. The second opening 46 is adapted to hang the dispenser from the support member 44. This embodiment for the second opening 46 has the advantage of engaging the container 16 with the support member 44 at the circular portion of the second opening preventing the container 16 from accidental disengagement during dispensing.

The engagement is accomplished because at least a portion of the second opening 46 has a first surface 76 and a second surface 78, which are at different elevations. Thus, the container 16 is slid onto the support member 44 along first surface 76 until the container 16 reaches the circular portion of second opening 46 where it drops down to second surface 78 upon being released. The first surface 76 then pushes against support member 44 during dispensing preventing the container 16 from being pulled off the support member 44 during dispensing. Alternative engagement schemes are possible. For instance, the circular portion of second opening 46 could comprise a triangle, a square, or any other geometric shape allowing for a first surface 76, and second surface 78. A square, instead a circle, would be advantageous on a support member 44 with a square cross-section, such as some conventional towel bars. A square portion of the second opening 46 engaging the square towel bar would further prevent twisting of the container 16 during dispensing.

Figure 3:
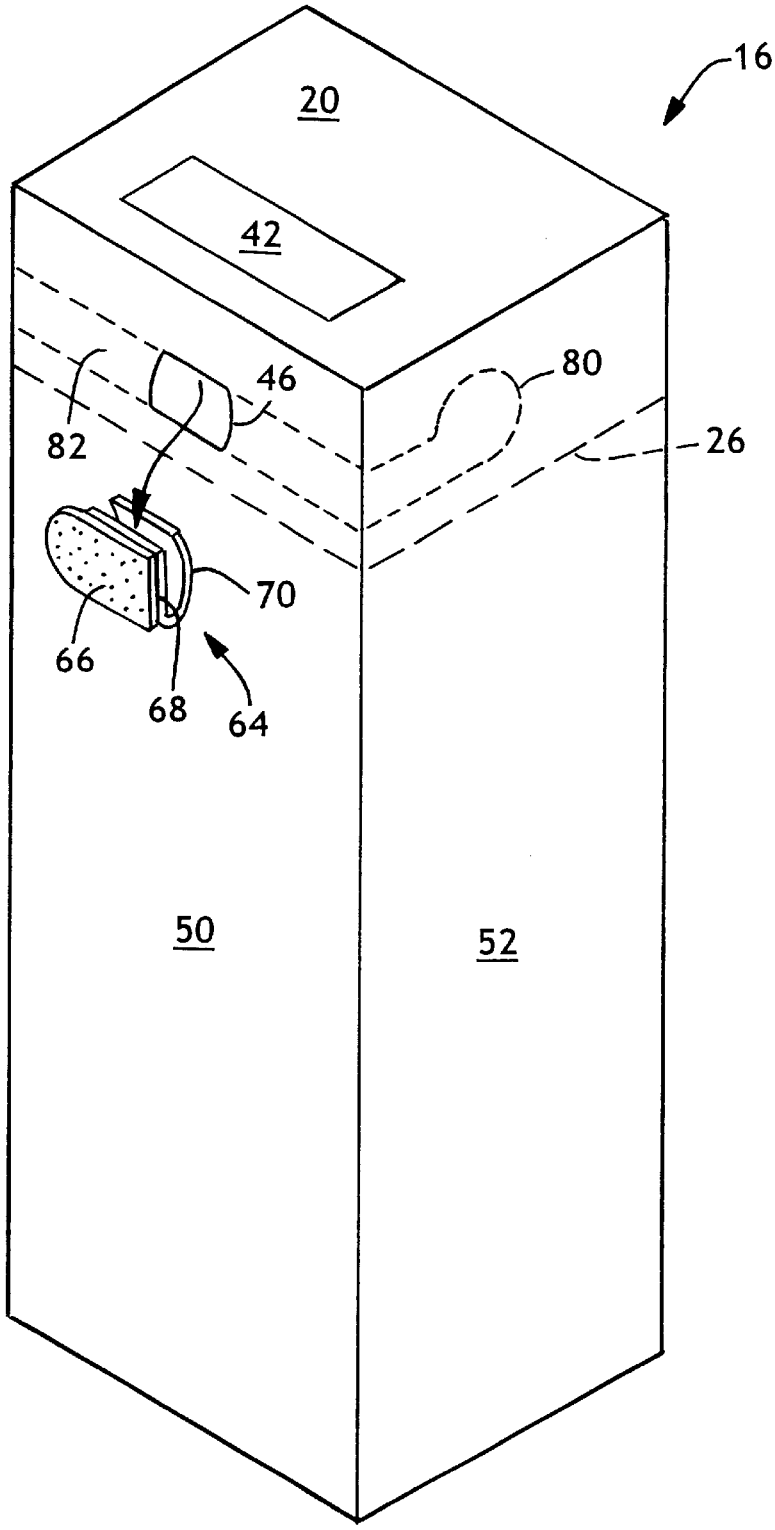
FIG. 3 is an isometric view of the embodiment of FIG. 1 showing an alternative hanging embodiment.

Referring to FIG. 3, in a specific embodiment the second opening 46 is adjustable by lines of perforations 80 that are scored into the container 16. The lines of perforation 80 form a second cover 82, which can be torn away from the container 16 creating the second opening 46. This enables the user to optionally remove the second cover 82, and hang the container 16 from the support member 44, or to use the dispenser as depicted in FIG. 1. The lines of perforation 80 enable the size and shape of the second opening 46 to be readily changed to adapt the container 16 to hang from different support members 44. The second cover 82, if desired, may completely seal the second opening 46 prior to removal.

In a specific embodiment, the lines of perforation 80 forming the second cover 82 leave a portion of the second opening 46 uncovered. The initial size of the uncovered portion of the second opening 46 is ⅞ inch by 1 inch. The uncovered portion of the second opening 46 serves two purposes. First, leaving a portion of the second opening 46 uncovered provides a convenient location for the insertion of a finger to grasp the second cover 82 enabling a consumer to more easily remove the second cover 82. Second, leaving a portion of the second opening 46 uncovered provides yet another dispensing option as shown in FIG. 3. The initial size of the second opening 46 enables a consumer to hang the container 16 from a support member 44 comprising a hook. Optionally, the container 16 can be hung from a support member 44 comprising a bar after removing the second cover 82 as shown in FIG. 2.

In a specific embodiment, Cord Clips With Command Adhesive, part number 17017 manufactured by 3M Construction and Home Improvement Markets Division, Box 33053, St. Paul, Minn., 55133 have been found especially effective as a support member 44. The hook 64 has a base 68, and an arcuate surface 70. The hook 64 has a removable adhesive strip 66, which allows for convenient attachment and removal of the hook support member from surfaces. This is accomplished by one end of the adhesive strip 66 extending past the base 68. A consumer pulls on the extended portion of the adhesive strip 66, stretching the adhesive strip 66 until its contact with the surface is broken releasing hook 64 from the surface.

The arcuate surface 70 is integral with the base 68 on one end, and nearly touches the base 68 on the other end. The width of the arcuate surface 70 is 13/16 inch or 1/16 inch less than a described embodiment for the width of the uncovered portion of the second opening 46. Because the arcuate surface 70 nearly touches the base 68, the container 16 is firmly engaged in the hook 64. This occurs from the flexing of the arcuate surface 70 to accommodate the thickness of the container 16, which in one embodiment is thicker than the gap between the arcuate surface 70 and the base 68.

Figure 4:
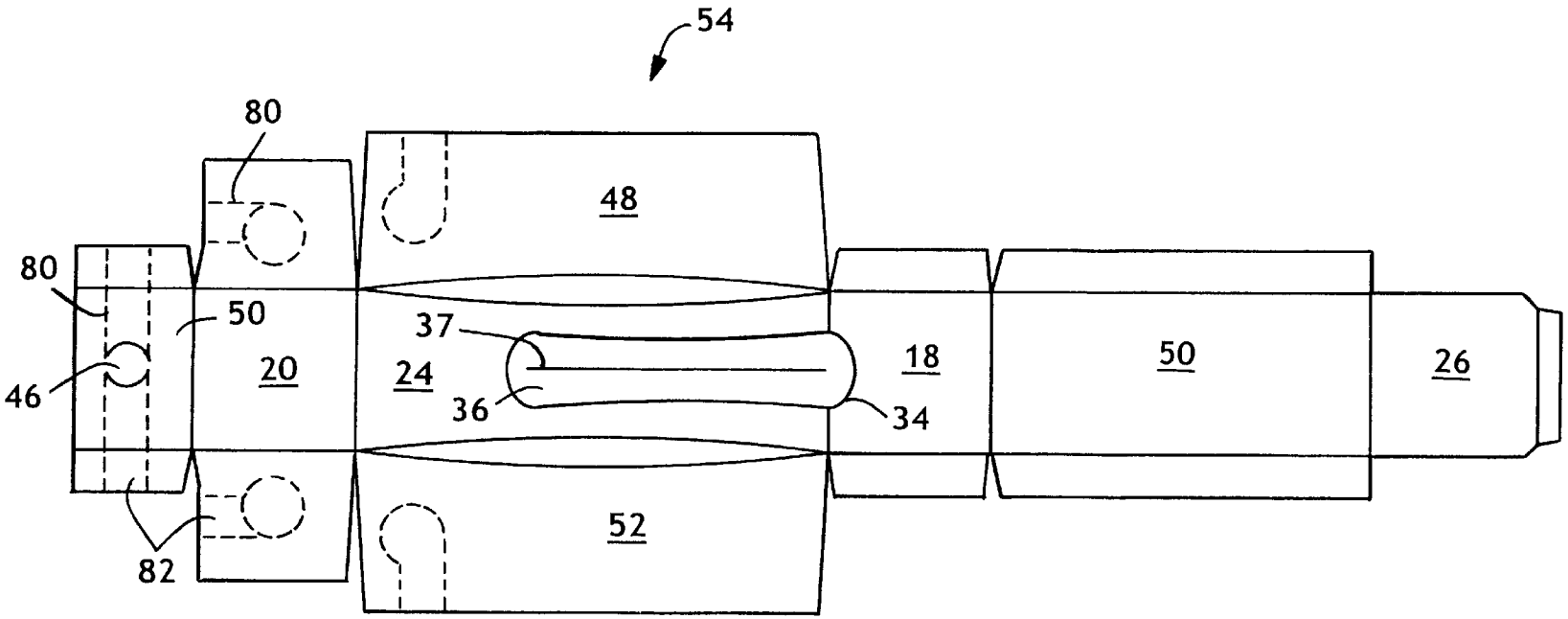
FIG. 4 is a plan view of a blank to make the container shown the above figures.

FIG. 4 shows a blank 54, which is folded and glued to produce the container 16. In one embodiment, the thickness of panels 48 and 52 are doubled in the area of the second compartment 32. This provides better structural integrity of the container 16 when engaging the support member 44. In a presently preferred embodiment, an interfolded stack of paper towels is inserted into the container 16 to produce a product, although the container 16 can be used to house other absorbent paper materials. Such a product has an advantage of having different dispensing modes, which reduce the product's counter space requirements, and which protects the absorbent paper towels from liquid damage.

Accordingly, while the invention has been described herein in detail in relation to specific embodiments, it is to be understood that this disclosure is only illustrative and exemplary of the invention, and is made merely for purposes of providing a full and enabling disclosure of the invention. The foregoing disclosure is not intended to be construed to limit the invention, or otherwise to exclude any other embodiments, adaptations, variations, modifications and equivalent arrangements; the invention being limited only by the claims appended hereto and the equivalents thereof.

We claim:

1. A method of dispensing an absorbent paper material in a container comprising the acts of:

removing at least one cover from the container having a first and a second opening, the cover covering at least a portion of the first or the second opening;

hanging the container from a support member engaging the second opening such that a center of gravity of the container and absorbent paper material is lower than the support member; and withdrawing the absorbent paper material through the first opening.

2. The method of claim 1 wherein the act of hanging the container comprises placing the container on a bar.

3. The method of claim 1 wherein the act of hanging the container comprises placing the container on a hook.

4. The method of claim 1 wherein the act of removing the cover changes the shape of the second opening from a hole to an elongated keyhole slot.

5. A method of dispensing an absorbent paper material in a container comprising the acts of:

providing a container having a partition attached to an interior surface of the container forming a first compartment and a second compartment, the container having a first end, a second end, a sidewall, and a first opening into the interior of the first compartment which contains the absorbent paper material;

placing the container on a surface with the second compartment beneath the first compartment such that a space provided by the second compartment elevates the absorbent paper material from the surface protecting the absorbent paper material from damage due any liquids on the surface; and withdrawing the absorbent paper material through the first opening.

6. The method of claim 5 wherein the act of placing the container on the surface further comprises attaching the container to the surface by an attachment member located on the second end.

7. The method of claim 5 wherein the attachment member is an adhesive.

* * * * *